United States Patent [19]

Chapek et al.

[11] Patent Number: 5,050,583

[45] Date of Patent: Sep. 24, 1991

[54] DEVICE FOR PROTECTIVELY COVERING HEARTHS

[76] Inventors: Anthony J. Chapek, 2425 Danver La., Buford, Ga. 30518; Robert E. Parks, 479 Loma Ct., Lilburn, Ga. 30247

[21] Appl. No.: 564,194

[22] Filed: Aug. 8, 1990

[51] Int. Cl.[5] ..... F24B 1/18

[52] U.S. Cl. ..... 126/500; 108/27

[58] Field of Search ..... 126/500, 544, 546, 12; 108/27; 5/100, 512, 493

[56] References Cited

U.S. PATENT DOCUMENTS

| | | | |
|---|---|---|---|
| 2,606,755 | 8/1952 | Samuels | 248/345.1 |
| 3,378,003 | 4/1968 | Scherer | 126/546 |
| 4,117,782 | 10/1978 | Cahill | 108/27 |
| 4,787,366 | 11/1988 | Bell | 126/500 |
| 4,865,015 | 9/1989 | Hasty et al. | 126/500 |
| 4,867,135 | 9/1989 | Stecker | 126/500 |
| 4,922,891 | 5/1990 | King | 126/500 X |

*Primary Examiner*—Larry Jones

*Attorney, Agent, or Firm*—Needle & Rosenberg

[57] ABSTRACT

A device for covering the sharp, front edge of an exposed hearth, to protect a child who may fall onto the hearth, comprising an elongated frame member having an inner surface which overlies the hearth edge, means for securing the frame member onto the hearth, means for adjusting the length of the frame member and a resilient outer covering for the frame member. Side elements may be attached to each outer end of the frame member so as to cover the side edges of the hearth.

5 Claims, 3 Drawing Sheets

DEVICE FOR PROTECTIVELY COVERING HEARTHS

BACKGROUND OF THE INVENTION

This invention relates to a device for protecting a young child from injury in a home and, more particularly, to a device for protectively covering at least the front edge of an exposed hearth.

In houses having fireplaces, it is common for the hearth to be built above the floor such that its sharp edges are exposed. A young child can hurt himself if he were to fall or bump against the hearth edge.

Thus, there is a need for a product which protects against such injury and is aesthetically pleasing but is removable from the hearth when the child has outgrown the need for such protection.

SUMMARY OF THE INVENTION

The present invention is a device that is detachably secured to a hearth edge and which provides a protective covering for the edge. The device includes a frame which overlies the edge and that is adjustable along its length, depending upon the length of the hearth edge. The frame includes a resilient covering about its exterior surface. Each of the outer ends of the frame includes caps that engage a portion of the side edges of the hearth so that when the length is properly adjusted, the caps grip the hearth to prevent the device from being accidentally dislodged.

The frame includes two identical, separate sections, each constructed of two wooden beams which are each rectangular in cross-section and which are joined together at right angles along their long edges.

The preferred length adjusting means comprises a pair of metal rods, each having a top portion rotatably secured into one of the opposed ends of the wooden beams and having its bottom portion threadingly received into the other of the opposed ends of the beams. Turning the rods in a particular direction shortens the frame to allow the caps to better grip the hearth sides.

The preferred length adjusting means also operates to detachably secure the device of the present invention to the hearth edge in the case where the front hearth edge runs directly up to a wall so that hearth sides are not available for the gripping action of the caps. In this case, caps are not used. The adjusting rods are turned in a direction so that the frame is lengthened until the outer ends of the frame comes into engagement with the walls. The engagement of frame and wall serves to hold the protective covering in place on the hearth edge.

When the frame is properly secured onto the hearth edge, the space between the opposed inner ends of the beams is filled with foam and a flexible centerpiece section having the same resilient outer protective covering is placed thereover and is secured into place. When in place, the flexible centerpiece section provides a unitary look to the device on the hearth.

BRIEF DESCRIPTION OF THE FIGURES OF DRAWINGS

DETAILED DESCRIPTION OF THE PREFERRED EMBODIMENT

Figure 1:
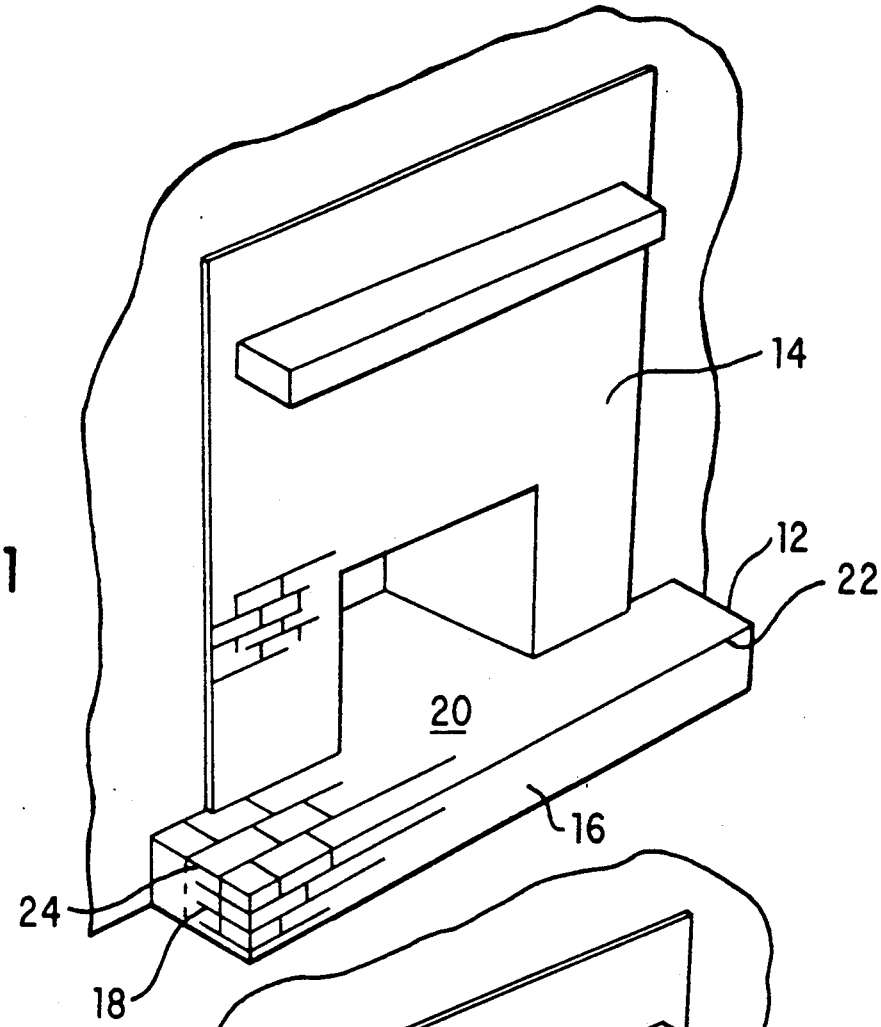
FIG. 1 is a perspective view of a fireplace hearth.
Figure 2:
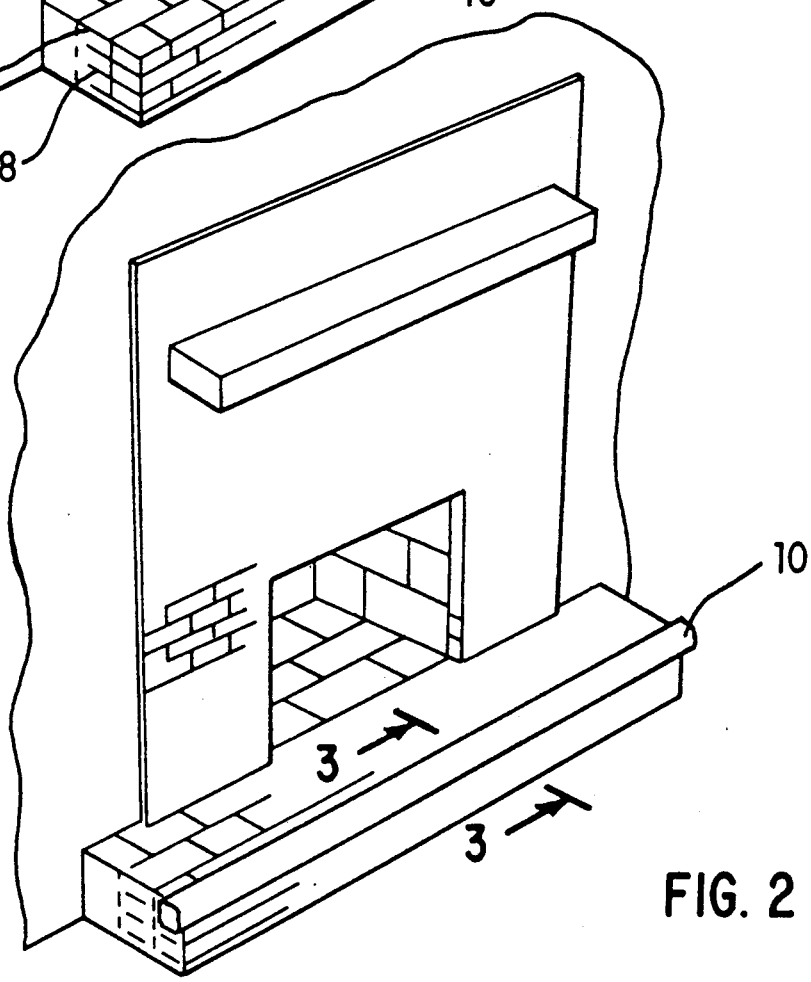
FIG. 2 is a perspective view of the hearth with the present invention installed thereon.

Referring to the figures of the drawings, the numeral 10 denotes generally the device of the present invention. It is used in connection with a conventional brick hearth area 12 of fireplace 14 which can be constructed of brick, stone or cement. The hearth 12 has a front vertical wall 16, side walls 18 and top surface 20. The juncture of top surface 20 and the top of front wall 16 forms a sharp front edge 22, with edges 24 being formed where each side wall 18 meets top surface 20. The edges 22, 24 present particularly dangerous surfaces for infants and toddlers who may fall and hit their heads thereon.

Figure 3:
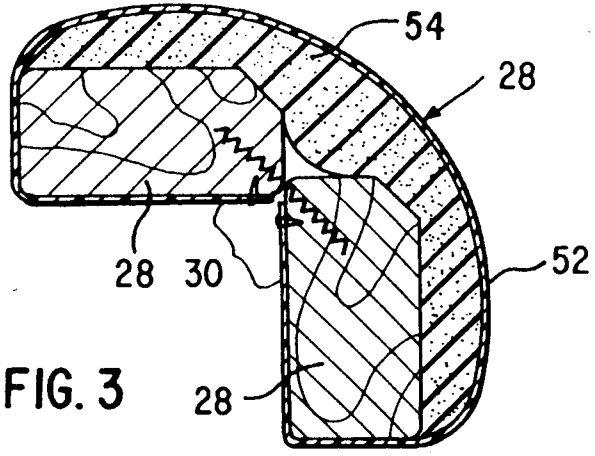
FIG. 3 is a vertical cross-sectional view of the device of the present invention taken along lines 3—3 in FIG. 2.
Figure 4:
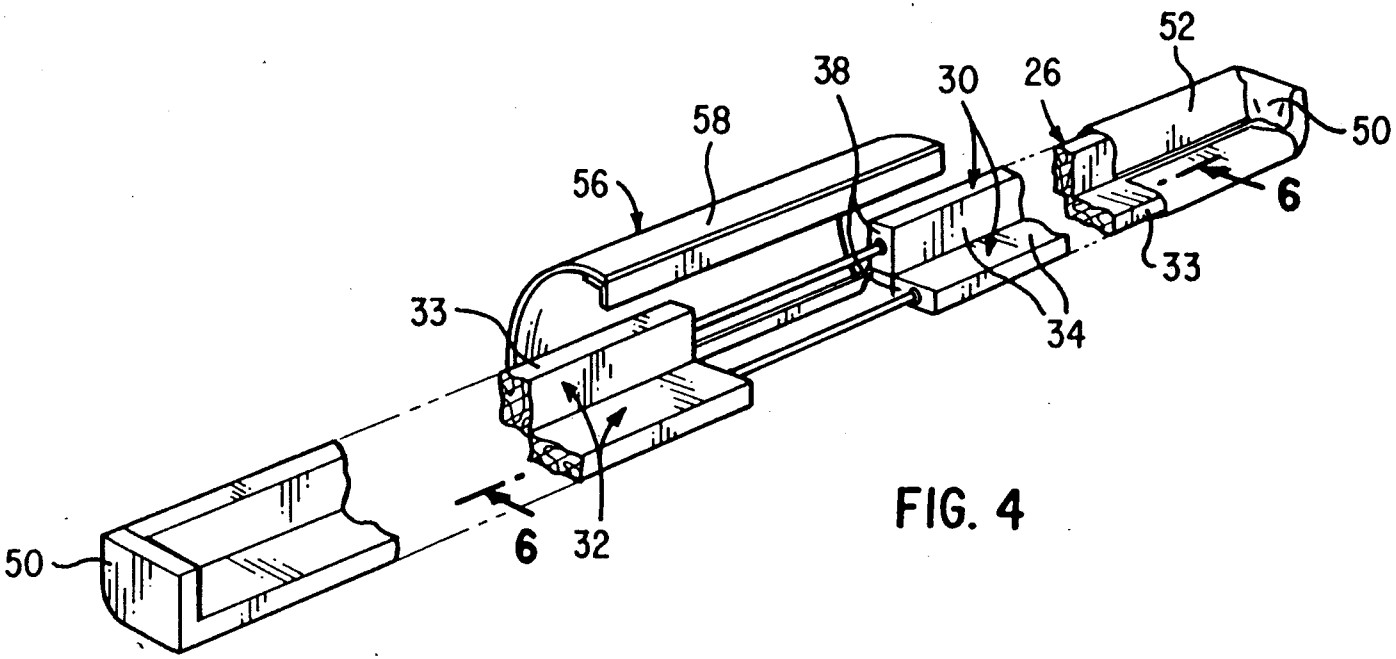
FIG. 4 is a perspective view of the present invention with the flexible covering exploded away for clarity.

Referring to FIG. 4, the device 10 includes a frame member generally denoted by the numeral 26 which has an inner surface that is complementary to hearth edge. More specifically the inner surface is complementary in shape to front wall 16, top surface 20 and edge 22 and has a resilient outer covering 28 to provide a protective cover for the frame member 26. The frame member 26 comprises a pair of identically dimensioned sections, each formed from a pair of elongated wooden pieces 30, 32 which are substantially rectangular in cross-section and which are joined together to form a right angle along respective longitudinally extending edges, as shown in FIG. 3. Any conventional means, including nails, braces and/or glue, can be used to join together the pieces 28, which also have outer sides 33. The pieces 30, 32 have exposed inner surfaces 34, either of which, when the device 10 is installed on the hearth 12, would engage wall 16 or top surface 20 since the sections are equal-dimensioned. Front edge 22 abuts the juncture of the pieces 28, when the device 10 is installed. The pieces 28 further include opposed, inner ends 36, 38.

Figure 6:
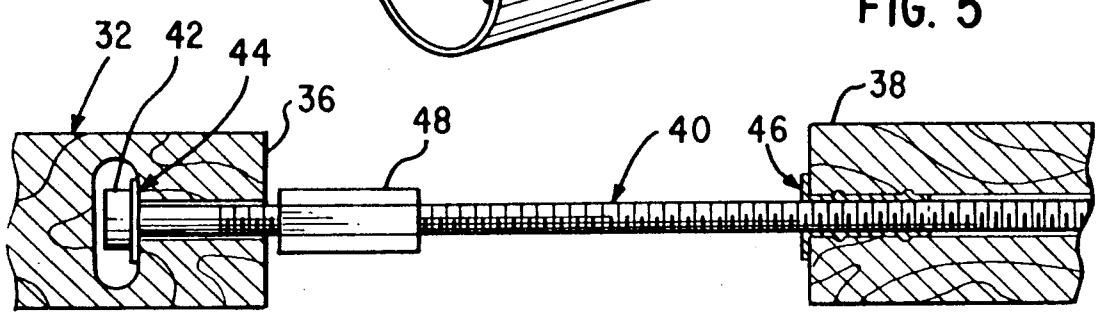
FIG. 6 is a vertical cross-section through the device of the present invention taken along lines 6—6 in FIG. 4.

A means for adjusting the length of the device 10 is provided and comprises a pair of threaded rods 40 having a top portion with a round cap portion 42 and a flange 44. The top portion of each rod 40 is rotatably received within a complimentary space formed within each of the pieces 32, as shown in FIG. 6, and longitudinally extends through end 36. The lower portion of the rod 40 is complementarily threaded to be received within a threaded cylindrical sleeve 46 which is inserted longitudinally into pieces 30 through ends 38. A hand grip 48 extends about a portion of the body of the rod 40.

The frame member 26 further includes an end cap 50 attached to the distal ends of pieces 30, 32.

The resilient covering 28 includes a vinyl outer surface 52 which may be of a color that blends with the color of the material comprising the hearth. An inner core 54 is formed of a foam-like material which provides the resiliency for the covering 28 and cushions blows received onto the outer surface 52. The outer surface 52 is secured to the inner surfaces 34 of the pieces 30, 32 and to the end caps 50 by any convenient means, such as by staples.

Figure 5:
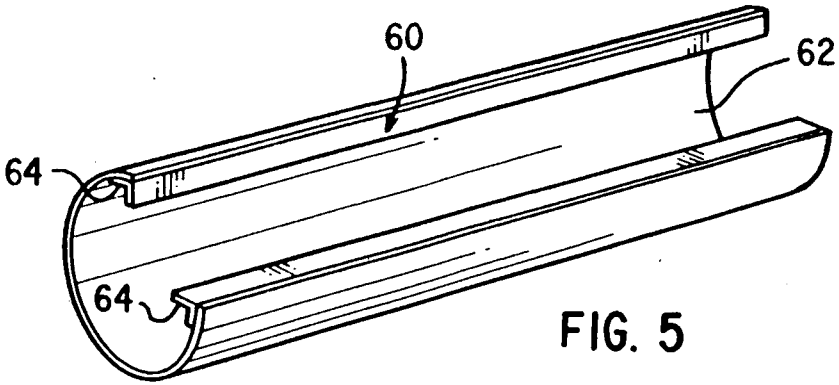
FIG. 5 is a perspective view of the flexible covering.

As shown in FIGS. 4 and 5, a centerpiece 56 is provided to cover the space formed between inner ends 36, 38 when the device 10 is installed. The centerpiece 56 includes a flexible vinyl outer surface 58 that has an L-shaped, rigid channel member 60 secured to the undersurface 62 of the centerpiece 56 along the opposed, inner edges. Spaced openings (not shown) are provided along leg 64 of the channel member 60 to enable the centerpiece to be secured to the inner surfaces 34 of the pieces 30, 32, as described below.

In its operation, the device 10 is placed over the sharp edge 22 by having inner surfaces 34 engage front wall 16 and top surface 20. The length of the device 10 has previously been adjusted such that it is a little greater than the length of edge 22. The grips 48 on each rod 40 are rotated so as to cause the rods 40 to be threaded into sleeves 46, thereby causing the sections of the device 10 to come together until the end caps 50 abut the side walls 18. The rods 40 are tightened slightly so as to insure that the device will not be accidentally dislodged.

Core material 54 is then inserted into the space formed between the opposed inner ends 36, 38. The centerpiece 56 is installed by inserting screws (not shown) into the pre-drilled holes (not shown) extending through the outer surface 58 and leg 64 and screwing the screws into the sides 33 of the pieces 30, 32. The device 10 is easily removable from the hearth 12 by reversing the above-described installation steps.

The above describes the preferred embodiment of the present invention. However, many modifications can be employed, such as constructing the frame member 26 of a rigid, unitary, molded synthetic material, such as plastic or having the separate wooden pieces constructed of a plastic-like material.

Additionally, numerous other means can be provided to adjust the length of the device 10, such as having one of the sections of the frame member 26 being slidably beneath the other or having the adjusting means comprised of straps or being spring-biased.

Another embodiment comprises unitary protective devices which cover edges 24 and which are connected through suitable brackets to the distal ends of device 10.

Figure 7:
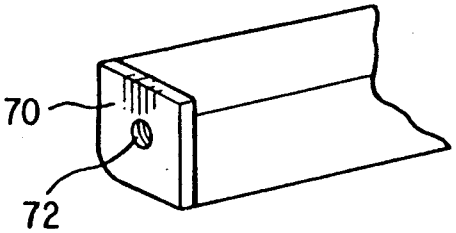
FIG. 7 shows a distal cap attached to frame member, highlighting the threaded-through hole.
Figure 8:
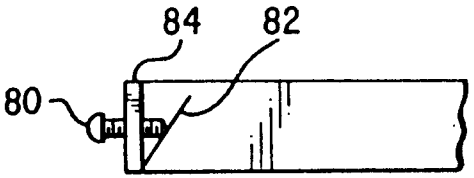
FIG. 8 is a side view of a frame member which shows a set screw engaging a flange through the cap.

Alternatively, the device of the present invention may be constructed with a fixed length frame member which approximates the length of the target hearth but is slightly greater in length than said hearth. The device in this configuration would be equipped with a metal flange 82 mounted interior to the distal cap 84 as shown in FIG. 7 and FIG. 8. One major surface of the flange faces and abuts the distal cap while the opposite major surface faces inward such that it may engage the hearth. The inwardly facing major surface of the flange may be fitted with a resilient foam covering so as to prevent or minimize damage to the hearth that may be caused by the engagement of flange to hearth. A threaded aperture 72 is provided through each distal cap 70 which is equipped with a flange, such that a set screw may be received therethrough. The set screw is used to press the flange into engagement with the hearth. The engagement of hearth and flange serves to detachably secure the device of the present invention to the hearth.

Figure 9:
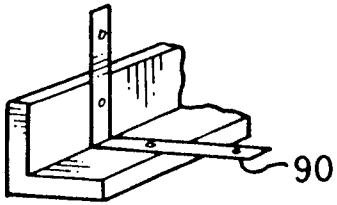
FIG. 9 shows the inner surfaces of a frame member with bracket attached.

FIG. 9 shows another embodiment of the invention wherein brackets are used to secure the protective covering to the hearth. L-shaped brackets 90 are attached to the inner surface of the frame. Both arms of these brackets extend out beyond the edges of the protective device. The brackets are then detachably secured to the hearth, typically with screws, thus fastening the protective covering to the hearth.

What we claim is:

1. A device for protectively covering an edge of an exposed hearth, comprising:

(a) a frame member having an inner surface shaped complementary to a hearth edge, and an outer surface, said frame member further comprising a pair of sections having opposed ends;

(b) a means for detachably securing the frame member onto the hearth over the edge;

(c) a resilient means on the outer surface of the frame member for providing a protective cover for the hearth; and (d) a means for adjusting the length of the frame member depending upon the length of the hearth edge wherein the means is positioned intermediate to the opposed ends of the frame member and the means for adjusting length includes a threaded member secured about its top to one of the opposed ends and having its bottom being threadedly received within the other of the opposed ends.

2. A device as claimed in claim 1 and further comprising a cap section which has the resilient means on its outer surface and means for mounting the cap over the space formed between the sections by the length adjusting means.

3. A device as claimed in claim 1, wherein the frame sections each include a pair of elongated wooden pieces which are rectangular-shaped in cross-section and which are joined together along their longitudinal edges to form a right angle.

4. A device for protectively covering the front edge of an exposed hearth, comprising:

(a) an elongated, first frame member having an inner surface which engages the hearth edge, wherein the frame member comprises a pair of wooden sections having opposed, inner ends and wherein the means for adjusting length comprises a rod having a top portion rotatably held in one of the inner ends and a threaded bottom portion threadedly received into the other inner end, whereby rotation of the rod expands or contracts the length of the frame member;

(b) means at each distal end of the frame member for securing the frame member onto the hearth edge;

(c) means for adjusting the length of the frame member, depending upon the length of the hearth; and (d) a resilient covering of the outer surface of the frame member.

5. A device as claimed in claim 4 and further including a second frame member connected to each of the distal ends of the first frame member and disposed in normal relationship to the first frame member, each second frame member having a length so as to overlie the side edges of the hearth.

* * * * *